US006317919B1

(12) United States Patent
Dahlin et al.

(10) Patent No.: US 6,317,919 B1
(45) Date of Patent: Nov. 20, 2001

(54) RAILCAR CLEANING APPARATUS

(76) Inventors: William G. Dahlin; William S. Pladson, both of 1712 Main Ave. #202, Fargo, ND (US) 58103

( * ) Notice: Subject to any disclaimer, the term of this patent is extended or adjusted under 35 U.S.C. 154(b) by 0 days.

(21) Appl. No.: 09/617,004

(22) Filed: Jul. 14, 2000

Related U.S. Application Data

(62) Division of application No. 09/188,270, filed on Nov. 9, 1998.

(60) Provisional application No. 60/105,479, filed on Oct. 23, 1998.

(51) Int. Cl.[7] ..... A47L 5/36

(52) U.S. Cl. ..... 15/314; 15/312.1; 15/340.1

(58) Field of Search ..... 15/340.1, 314, 15/312.1

(56) References Cited

U.S. PATENT DOCUMENTS

| | | | | |
|---|---|---|---|---|
| 3,104,720 | | 9/1963 | Sullivan . | |
| 3,150,404 | * | 9/1964 | Johnson | 15/340.1 X |
| 3,348,258 | * | 10/1967 | Daneman | 15/314 |
| 3,541,631 | | 11/1970 | Kluge et al. . | |
| 3,594,848 | * | 7/1971 | Atkinson | 15/314 |
| 3,600,224 | | 8/1971 | Stilwell . | |
| 3,616,940 | | 11/1971 | Milner, Jr. . | |
| 3,665,545 | | 5/1972 | Beekman . | |
| 3,955,236 | | 5/1976 | Mekelburg . | |
| 3,995,754 | * | 12/1976 | DeKoning | 15/340.1 X |
| 4,200,950 | * | 5/1980 | Coverley | 15/314 |
| 4,222,457 | | 9/1980 | Ashworth . | |
| 4,322,868 | | 4/1982 | Wurster . | |
| 4,366,594 | * | 1/1983 | Hyams | 15/314 |
| 4,643,273 | | 2/1987 | Stokoe . | |
| 4,657,109 | | 4/1987 | Sterner . | |
| 4,659,262 | * | 4/1987 | Van Alst | 15/340.1 X |
| 4,679,653 | | 7/1987 | Pasquarette, Jr. et al. . | |
| 4,746,024 | | 5/1988 | Hensler . | |
| 4,775,029 | | 10/1988 | MacDonald et al. . | |
| 5,142,732 | | 9/1992 | Davis . | |
| 5,159,737 | * | 11/1992 | Kimura et al. | 15/312.1 X |
| 5,239,727 | * | 8/1993 | Roestenberg | 15/314 X |
| 5,846,334 | | 12/1998 | Hoce . | |

FOREIGN PATENT DOCUMENTS

| | | |
|---|---|---|
| 2243359 | 3/1974 | (DE) . |
| 141552 | 5/1985 | (EP) . |

* cited by examiner

*Primary Examiner*—Chris K. Moore

(57) ABSTRACT

A mobile vacuum cleaner for removing particulate materials from a chamber of a railcar or container is mounted on a motor truck operable to locate the vacuum cleaner adjacent a railcar. The cleaner has a material pick-up hose connected to a box and a motor driven fan for drawing air through the hose and box to pick up particulate materials from the chamber of the railcar and transport the particulate materials to the box. A lift device mounted on the truck has articulated booms and a work person carrier that can be located in the chamber of the railcar allowing the work person to move the hose adjacent the particulate material in the chamber and visually observe the cleaning operation.

23 Claims, 5 Drawing Sheets

RAILCAR CLEANING APPARATUS

CROSS REFERENCE TO RELATED APPLICATIONS

This application is a division of U.S. application Ser. No. 09/188,270 filed Nov. 9, 1998 application Ser. No. 09/188,270 claims the priority of U.S. Provisional Application Serial No. 60/105,479 filed Oct. 23, 1998.

FIELD OF THE INVENTION

The invention is in the field of mobile equipment for cleaning bulk and particulate materials from railcars, truck trailers, and containers. The mobile equipment includes a motor vehicle or truck having a vacuum cleaning apparatus and a lift device for moving a work person carrier and work person on the carrier to a location within the chamber of the railcar or container to enable the work person to control the location of a vacuum hose to pick up particulate materials in the chamber.

BACKGROUND OF THE INVENTION

Mobile pneumatic granular material conveying systems are used to unload and transport granular materials from vehicles, such as railcars, barges, and ship holds, to storage silos and factories. G.V. Aalst in U.S. Pat. No. 4,659,262 describes such a mobile pneumatic granular material conveying system having an articulated vacuum arm supporting a hose for carrying material from an intake nozzle to a material storage tank. An operator located near the material storage structure uses a remote control device to position the vacuum arm to locate the nozzle in the material so that the material is drawn into the hose and transported to a storage tank. A vacuum machine and boom mounted on a motor truck is disclosed by H.J. Davis in U.S. Pat. No. 5,142,732. The boom supports a material pick up hose and a bulk material separator operable to remove heavy bulk materials without materially reducing the vacuum in the hose. These vacuum conveying and boom structures do not allow the work person to be positioned in the chamber or space being cleaned during the cleaning process. The work person is not in a position that allows for visual inspection of the chamber and movement of the material pick up hose to a location to effectively and efficiently remove particulate materials from the chamber of a railcar or container. Railcars have bottom gates that allow the bulk load carried by the railcar to be unload by allowing the load to flow down. Residual load or particulate materials adhere to the walls of the railcar or remain in the chamber of the railcar. The residual particulate material are removed from the chamber of the railcar with the vacuum cleaning apparatus of the invention.

SUMMARY OF THE INVENTION

The invention is a method and an apparatus for cleaning chambers and spaces of railcars, truck trailers, containers, and structures for accommodating bulk or particulate materials, such as grain, sand, plastic pellets, ore and fly ash. The work person has direct visual inspection and control of the cleaning operation to efficiently and effectively remove particulate materials from the chambers. A motor truck is used to transport a vacuum cleaner and movable lift device supporting a work person carrier, such as a basket used to support a work person. The truck is driven to a location adjacent an open top railcar, truck trailer, or container having a chamber with residual particulate materials. The vacuum cleaner has an elongated hose that is extended into the chamber. The hose has an air inlet opening which allows particulate material to be drawn into the hose and transported to a box used to store the particulate materials. The lift device is operable to position the work person carrier and work person thereon within the chamber to allow the work person to visually locate and manipulate the position of the hose and it's air inlet opening adjacent the particulate material so that the particulate material is drawn into the hose. This allows the work person to clean the railcar chamber in minimum time and will reduce labor.

The vacuum cleaner has a box or housing with an enclosed internal chamber coupled to a motor driven fan. The fan operates to draw air from the chamber of the bin and move air through air inlet opening and hose to transport particulate materials to the bin. The lift device has a stand mounted on the truck. A first or main boom pivotally connected to the stand is selectively raised and lowered with a first hydraulic cylinder. A second boom is pivotally connected to the outer or remote end of the main boom. A second hydraulic cylinder is pivotally connected to the main boom and a toggle linkage. The toggle linkage has pairs of links pivotally connected to the first and second booms. The second cylinder operates to move the toggle linkage to a folded position to move the second boom to an extended position relative to the first boom. When the second cylinder is elongated the toggle linkage is extended and moves the second boom to a folded storage position adjacent a side of the first boom. The work person on the work person carrier located in the chamber of the railcar operates controls mounted on the second boom to actuate the first and second cylinders and a turntable operable to swing the left device about an upright axis. The work person operates the controls to change the up, down, and lateral locations of the work person carrier. The work person on the carrier manipulates the hose to clear the chamber of the railcar or container of particulate material and visually observe the cleaning of the chamber. The hose can be attached to the second boom or work person carrier to permit the movement of the second boom to change the location of the hose relative to the chamber of the railcar.

DESCRIPTION OF PREFERRED EMBODIMENT OF VACUUM RAILCAR CLEANER

Figure 1:
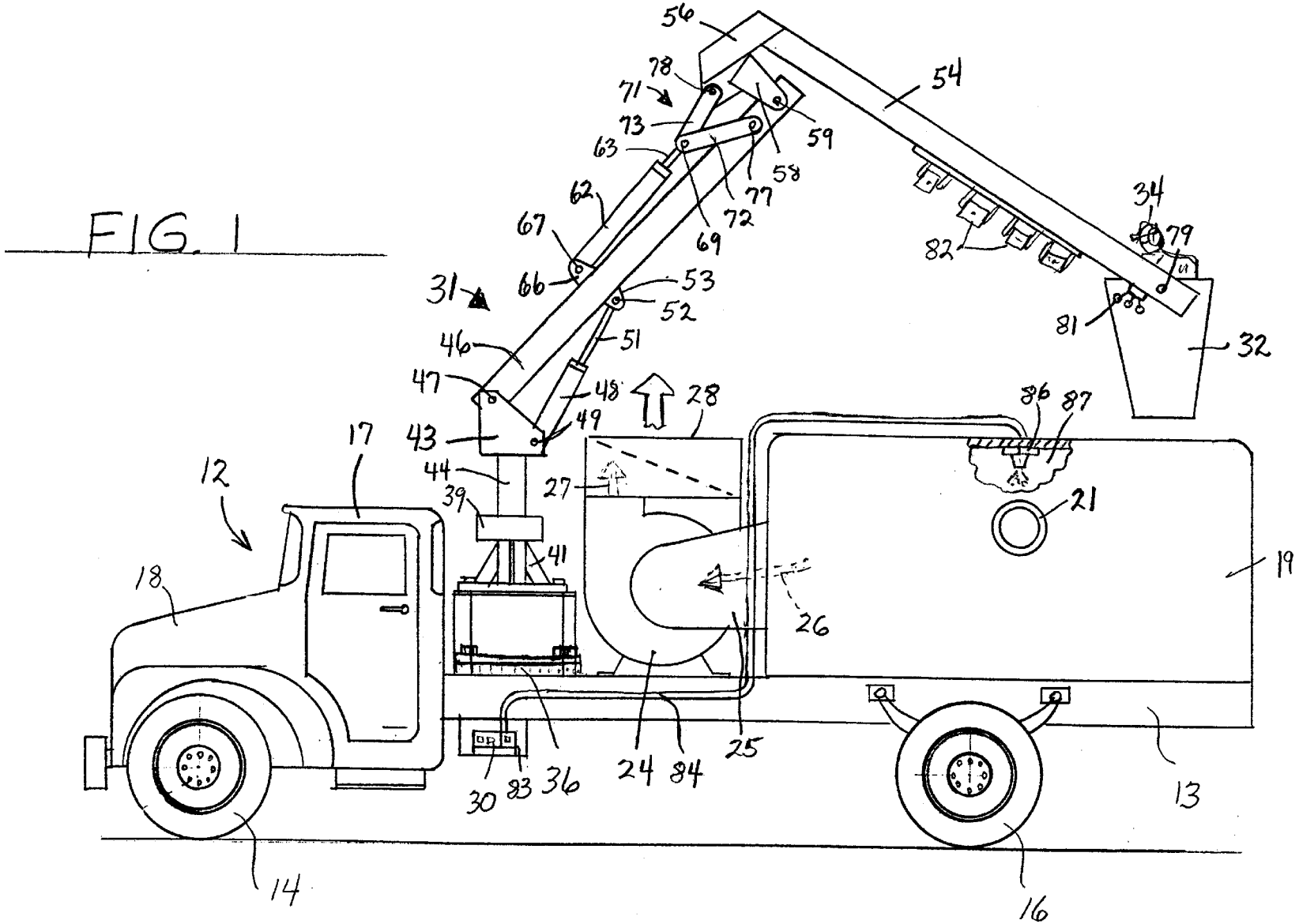
FIG. 1 is a side elevational view of a vacuum railcar cleaner truck having an articulated lift device and a work person carrier constructed in accordance with the present invention.
Figure 2:
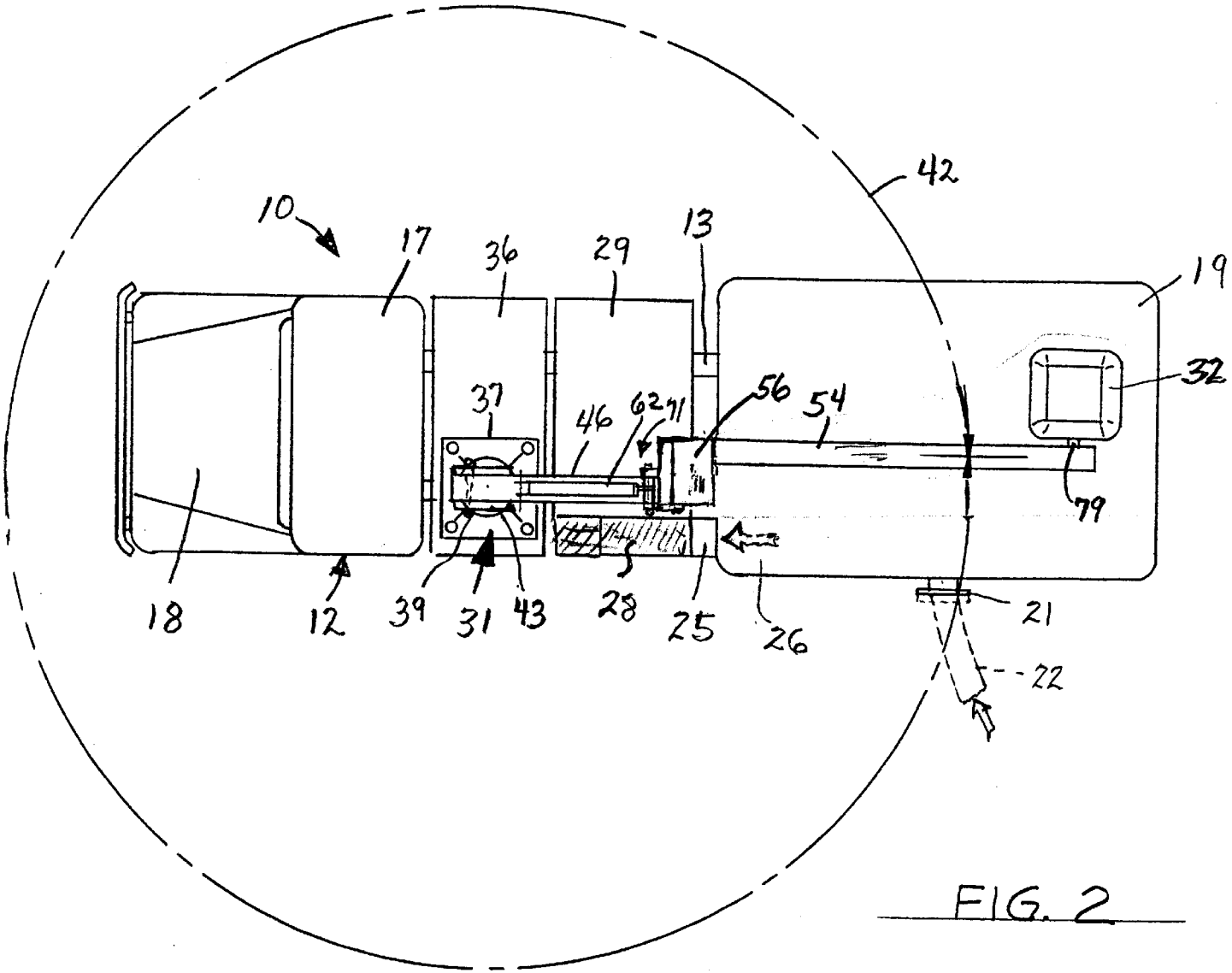
FIG. 2 is a top plan view of the truck, lift booms, and work person carrier of FIG. 1.
Figure 6:
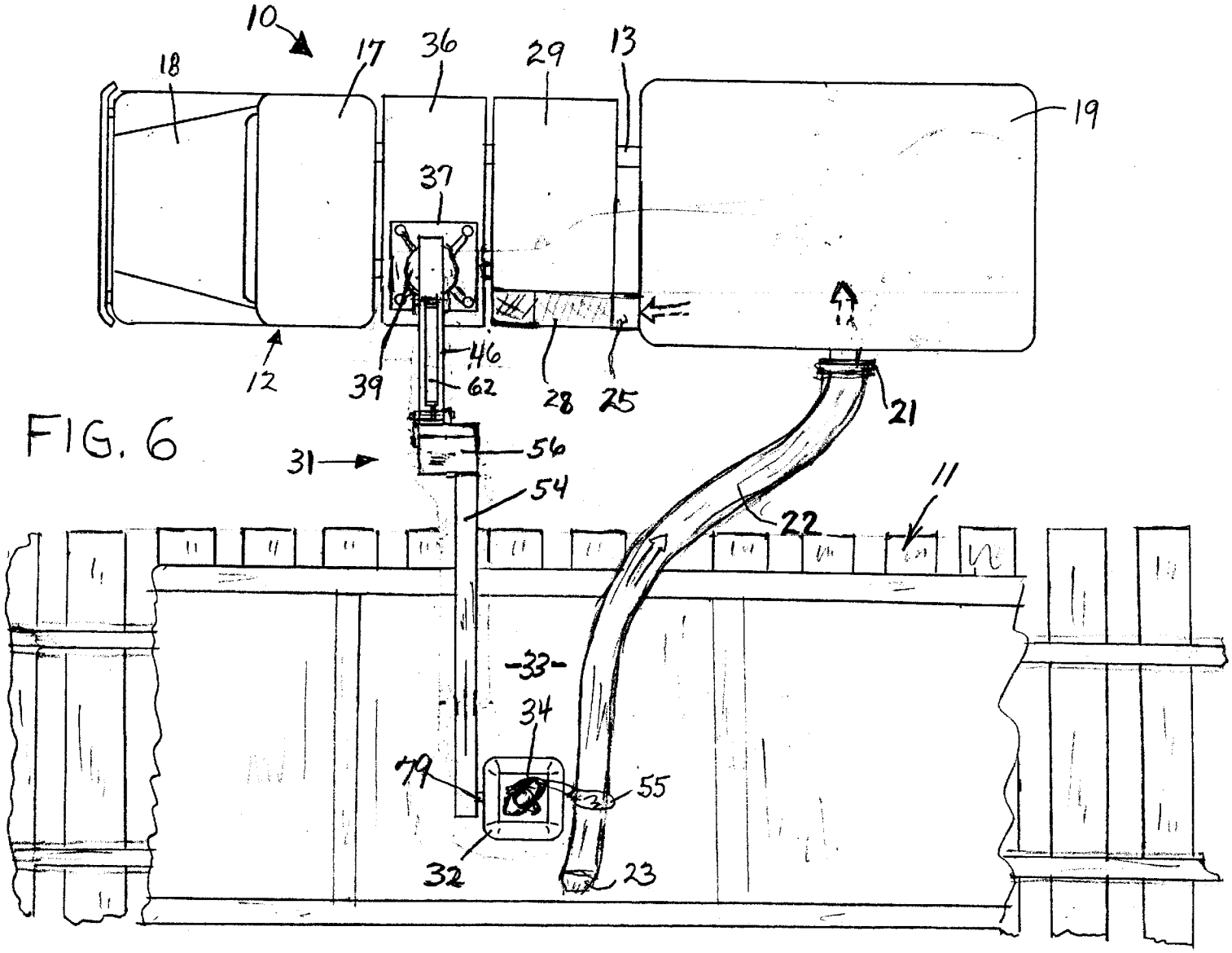
FIG. 6 is a top plan view of the vacuum railcar cleaner truck and open top railcar showing the method of cleaning the railcar.
Figure 1:
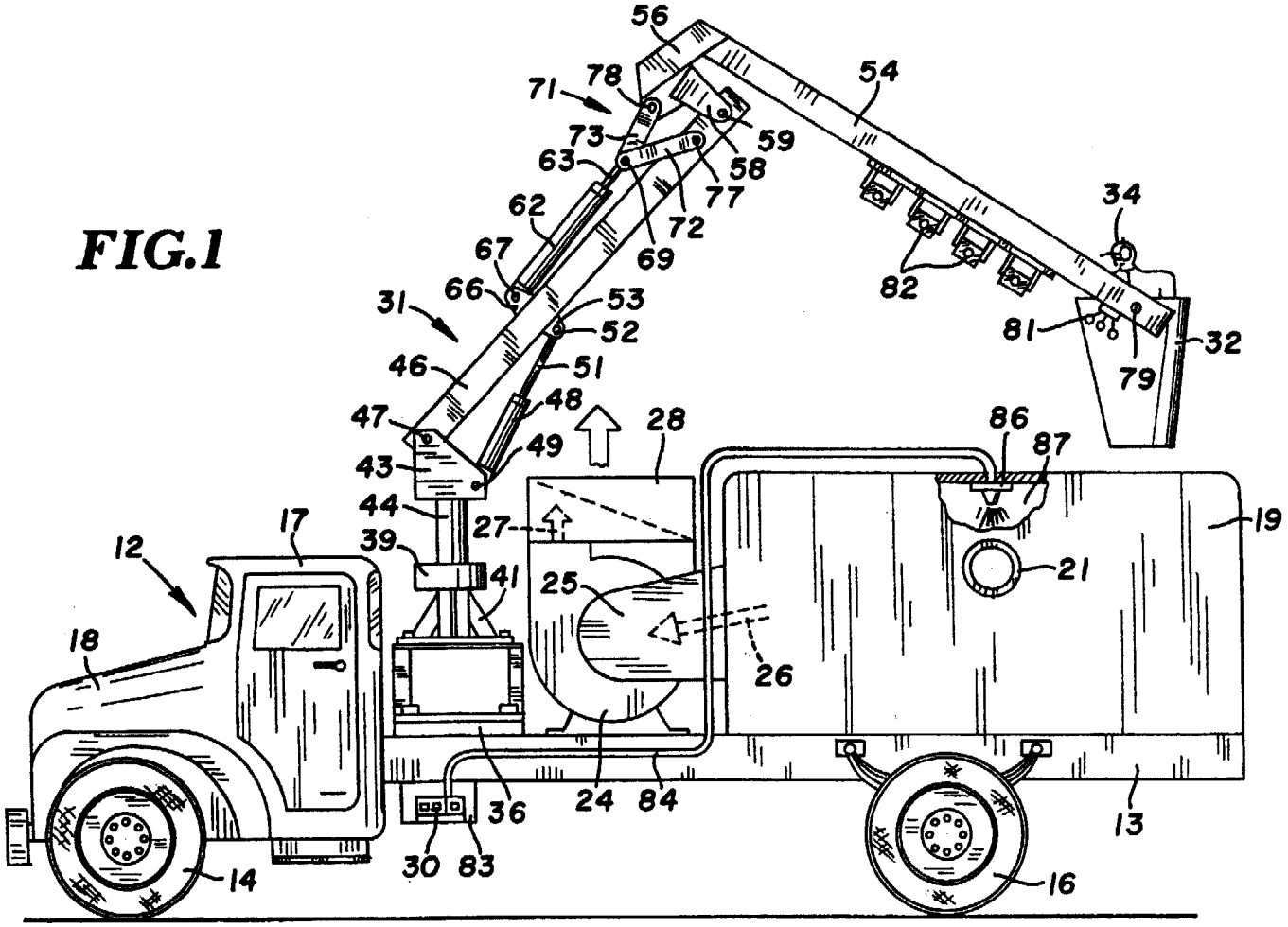
Figure 2:
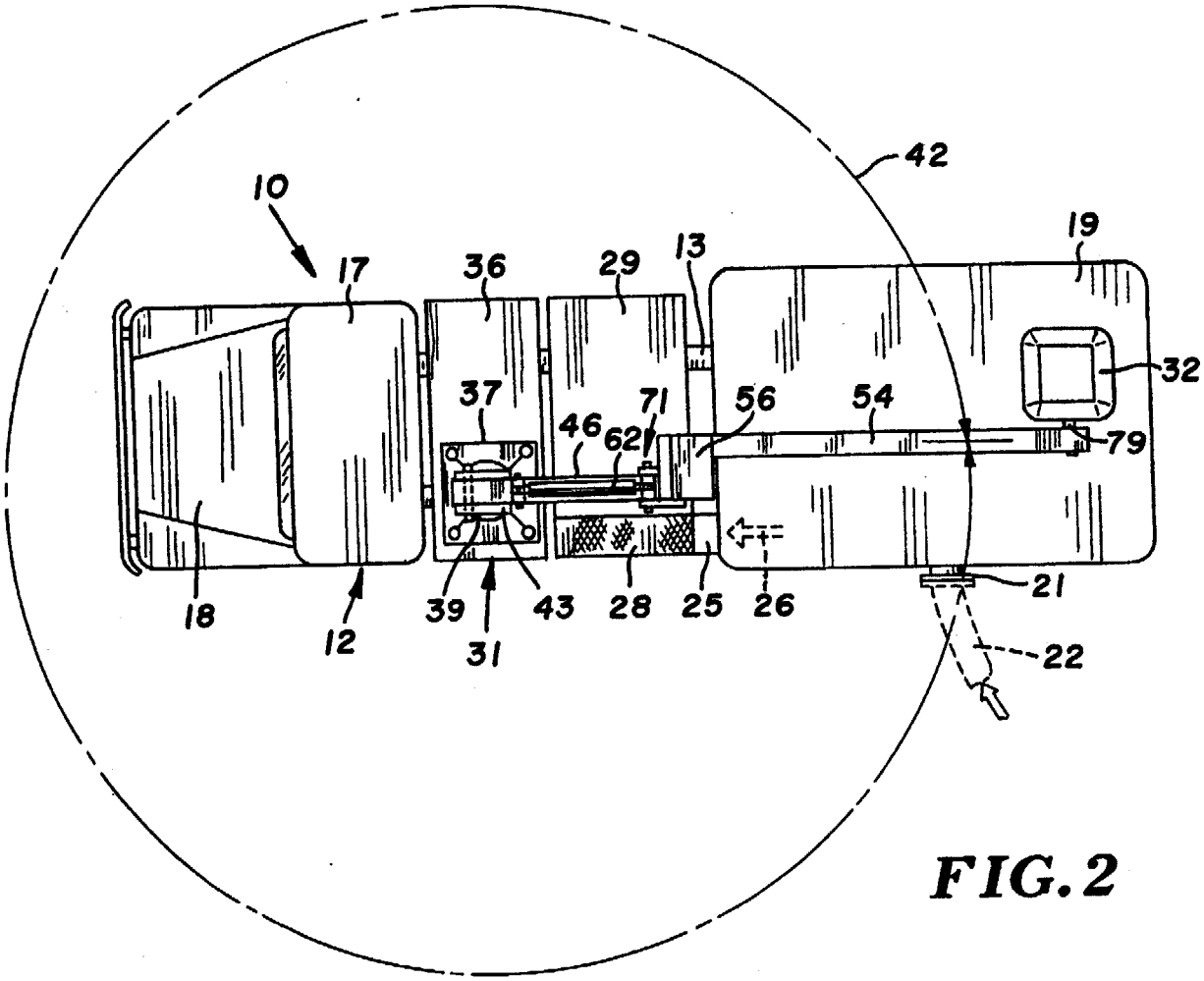
Figures 3, 4:
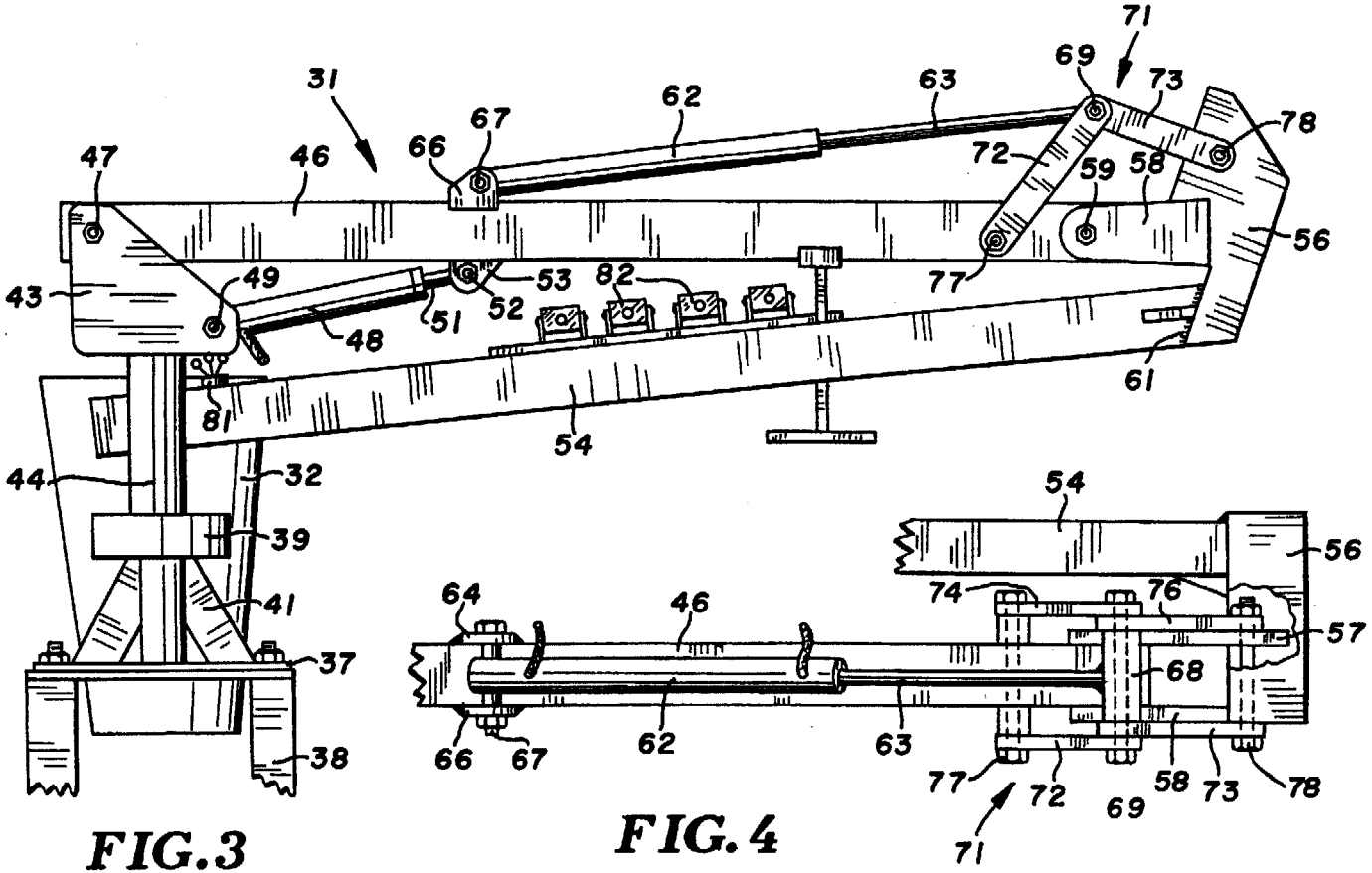
Figure 5:
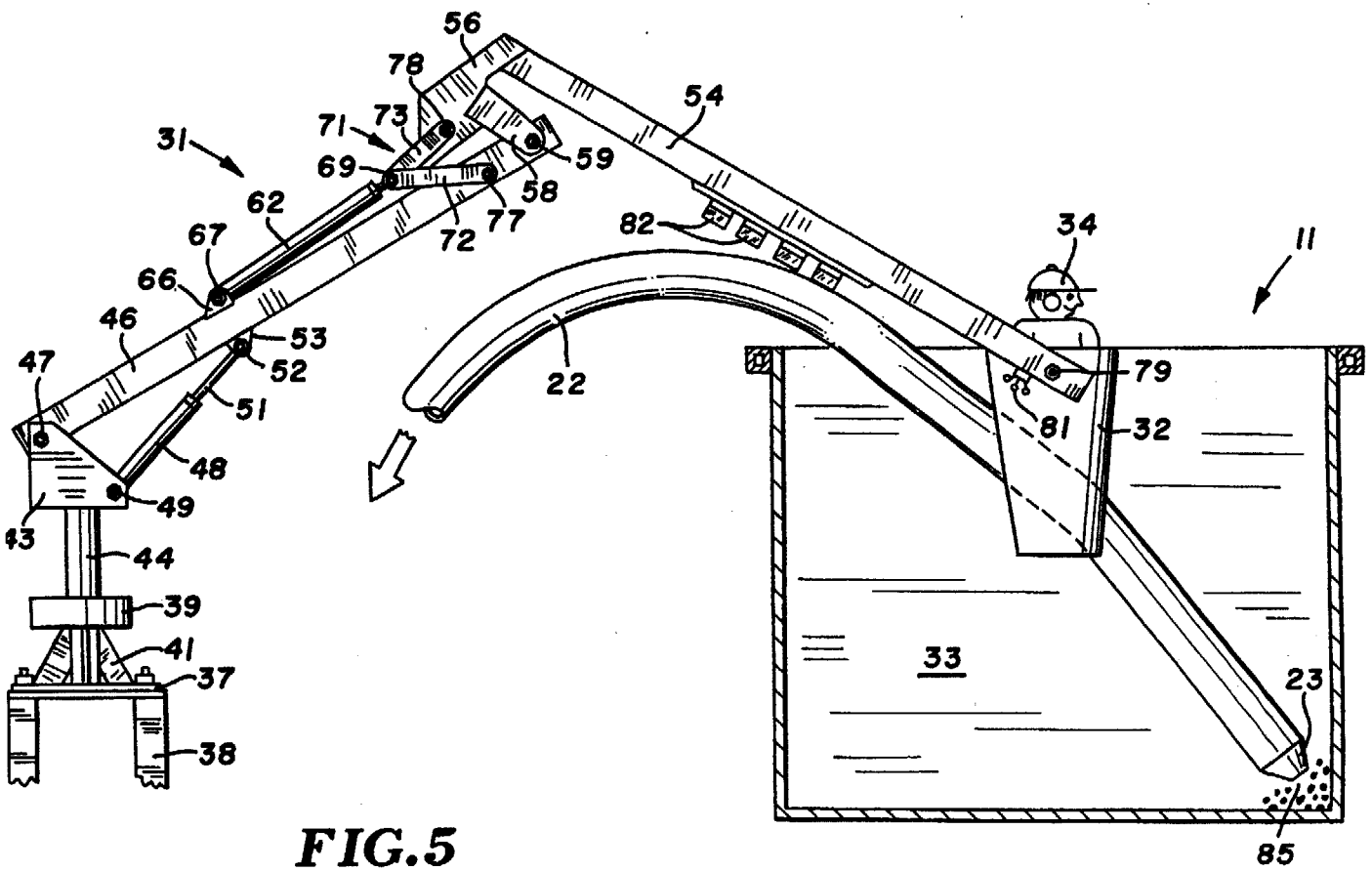
Figure 6:
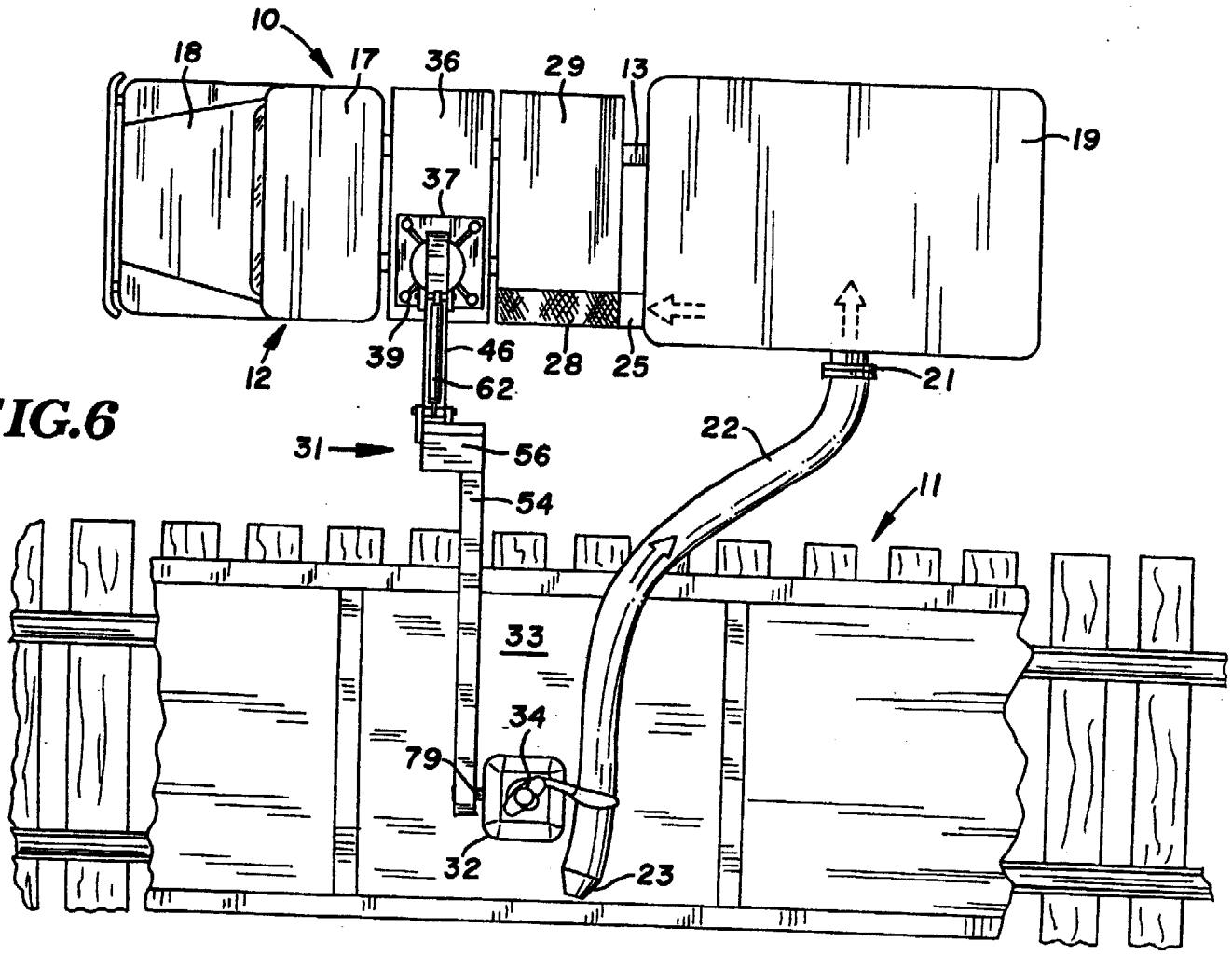

The vacuum railcar cleaner 10, shown in FIGS. 1, 2, and 6, is used to efficiently clean gondolas or open top rail cars 1 that transport particulate materials, such as grain, sand, coal, plastic beads, fly ash and taconite ore. Cleaner 10 is operable to clean other structures, such as open top tanks and containers, truck trailers, barges, rooms, and ship holds. The following description is directed to the cleaning of particulate materials from open top railcars. The cleaner 10 comprises mobile equipment that is moved to the location of the railcars and used to clean the inside of the railcars of residual load herein termed particulate materials. The railcars remain coupled as the equipment is moveable along a line of railcars or to selected railcars in a train of cars.

Railcar cleaner 10 has a conventional motor truck or lorry 12 which includes an elongated longitudinal frame 13 supported on a roadway or ground surface with front steering wheels 14 and rear drive wheels 16. An operator's cab 17 mounted on frame 13 is located behind hood 18. An internal combustion engine (not shown) is located below hood 18.

A rectangular shaped tank or box 19 is mounted on frame 13 above drive wheels 16. Box 19 has an enclosed internal chamber for collecting and holding the particulate materials picked up from the load chamber of the railcar. An air and material inlet tube or nipple 21 mounted on a side of box 19 is attached to an elongated flexible hose 22 having a nozzle 23 at it's forward or distal end. Hose 22 has sufficient length to extend from box 19 over a side of railcar 11 and into the load carrying chamber 33 of the railcar 11. Nozzle 22 has a cone shape that converges to its inlet opening. Air rapidly flowing through the inlet opening of nozzle 23 draws particulate materials in the bottoms of railcar chamber 11 into hose 22. The particulate materials are discharged from hose 22 into collection box 19. Box 19 has a bottom gate (not shown) to allow the collected materials to flow out the box. The interior of box 19 has baffles that restrict movement of particulate materials and allow the particulate material to settle or separate from the flowing air. Other structures, such as doors, can be used to allow the collected materials to be removed from box 19. The dust and air entrained particulate materials in the interior of box 19 are spayed with water which collects the dust. As shown in FIG. 1, a water pump 83 mounted on frame 13 adjacent motor control 30 discharges water under pressure into a line 84 connected to a nozzle 86. Nozzle 86 mounted on top of box 19 directs a spray of water into box chamber 87 to control the dust in the chamber. One or more nozzles can be used to dispense sprays of water into chamber 87.

A fan or air mover 24 mounted on frame 13 operates to draw air from the inside of box 19 and generate air suction pressure on air drawn into nozzle 23 and flowing in hose 22. An air inlet housing 25 connects fan 24 with the front wall of box 19 whereby air in box 19 flows into fan 24 as shown by arrow 26. Air is discharged upwardly from fan 24, shown by arrow 27 in FIG. 1, into an air filter 28 mounted on top of fan 24. Filter 28 removes dirt and dust from the air which is discharged into the environment. An internal combustion engine 29 mounted on frame 13 is drivably connected to fan 24. The speed of engine 29 is adjusted to change the suction pressure of air in hose 22 and box 19. A motor control 30 mounted on frame 13 is used by the work person to regulate the speed of engine 29.

Figure 5:
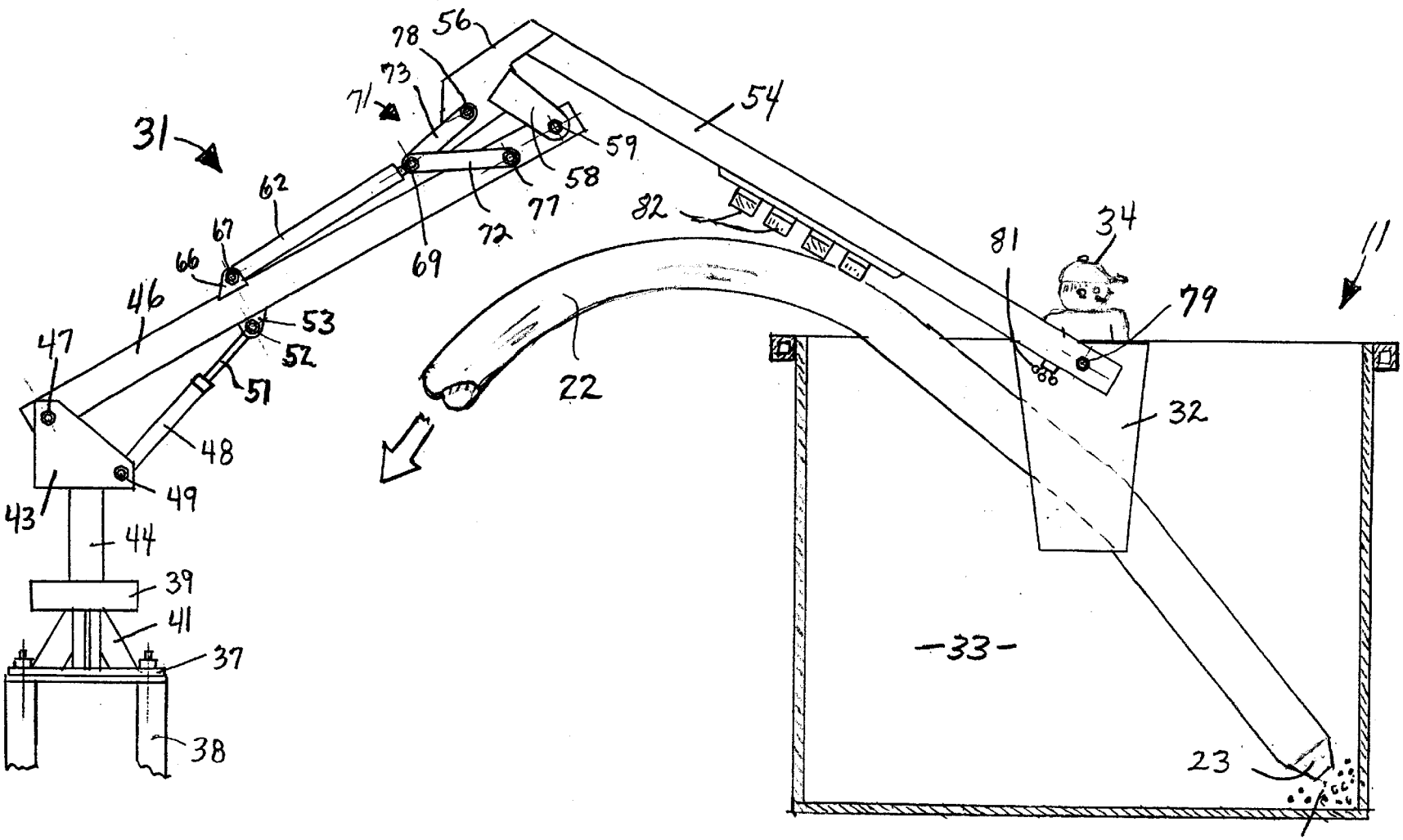
FIG. 5 is a side elevational view of the articulated booms in extended position with the work person carrier located within the load chamber of an open top railcar.

The cleaner 10 has a lift device or crane, indicated generally at 31, for supporting and moving a work person carrier, shown as a basket or bucket 32 to a desired location. Carrier 32, as shown in FIGS. 5 and 6, can be placed in railcar load chamber 33 so that a work person 34 can control the position of nozzle 23 in chamber 33 to pick up material from the bottom and sides of chamber 33 and visually observe the cleaning of the chamber 33.

Lift device 31 is secured to a platform 36 mounted on frame 13 between cab 17 and engine 29. Lift device 31 has a support comprising a mounting plate 37 and posts 38 securing plate 37 to platform 36. A turntable 39 located above plate 37 with a standard or support members 41 is operate to allow carrier 32 to be moved in a circular path around a vertical axis, shown at 42 in FIG. 2. A hydraulic or electric motor (not shown) is used to drive turntable 39. Other structures can be used to turn lift device 31 in an arcuate path relative to a vertical axis.

A U-shaped member 43 mounted on a post 44 connected to turntable 39 is pivotally connected to a main boom 46 with pivot member or bolt 47. Boom 46 is an elongated linear square metal tube. Boom 46 can have other shapes, such as cylindrical. A hydraulic cylinder 48 connected with a pivot bolt 49 to U-shaped member 43 has a piston rod 51 connected with a pivot bolt 52 to ears 53 secured to the bottom of boom 46. Cylinder 48 functions to selectively raise and lower boom 46 as shown in FIGS. 1, 3, and 5.

Figures 3, 4:
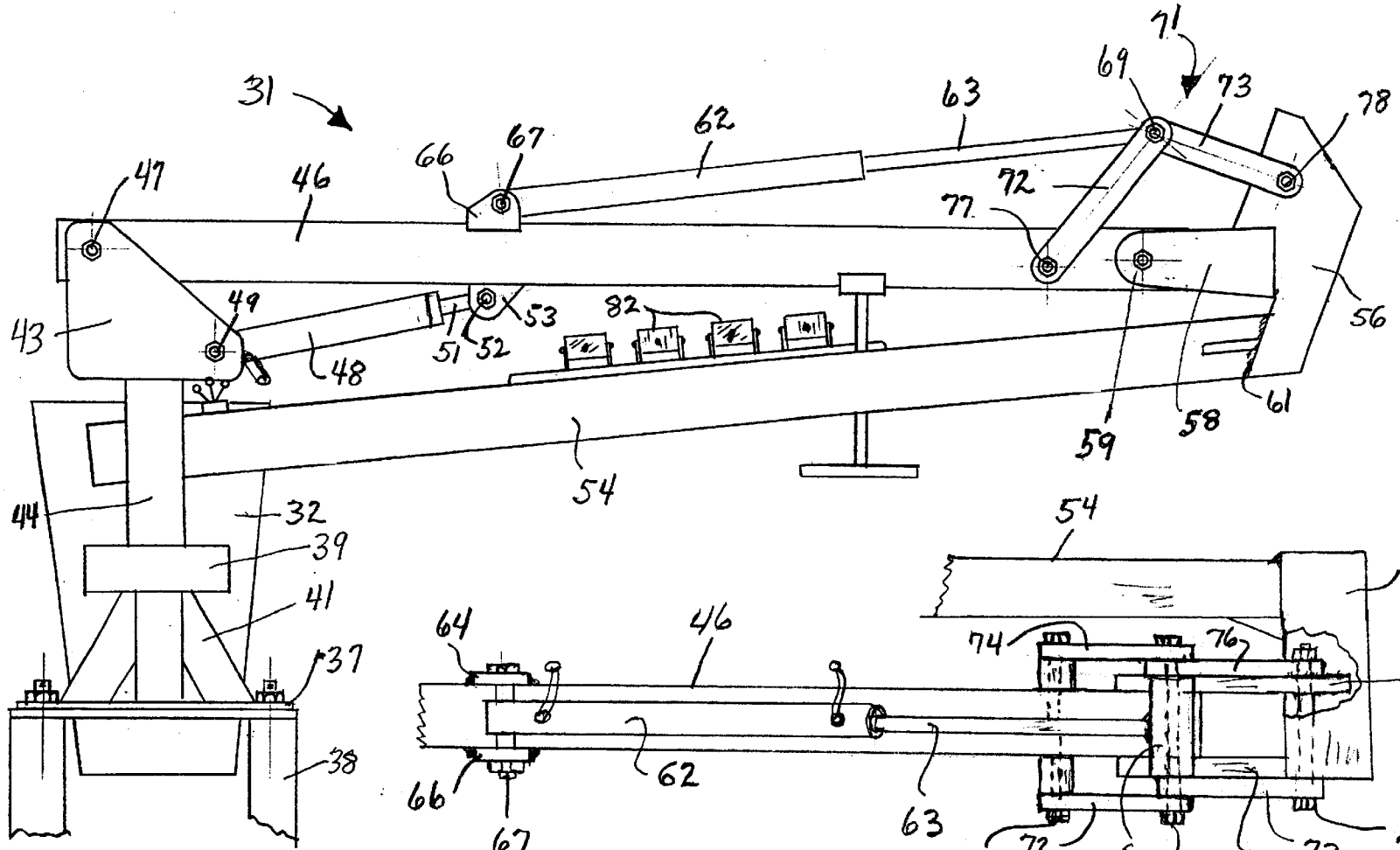
FIG. 3 is a side elevational view of the articulated booms of the lift device and work showing the booms in folded positions.
FIG. 4 is a top plan view of the outer ends of the booms of FIG. 3.

As shown in FIGS. 3 and 4, an elongated linear secondary boom 54 located adjacent a side of boom 46 is joined to the outer end of boom 54 with a connecting member 56. Member 56 is a box-like housing having a pair of arms 57 and 58 extended adjacent opposite sides of the outer end of boom 46. A pivot pin or bolt 59 pivotally connects arms 57 and 58 to boom 46. Pivot bolts 47 and 59 are located in parallel transverse axes relative to the length of boom 46. The inner or proximal end of boom 54 extends into member 56 and is secured thereto with welds.

A hydraulic cylinder 62 pivots boom 54 between a folded storage position, shown in FIGS. 3 and 4, and a raised or extended position, shown in FIGS. 1, 5, and 6. Cylinder 62 has a double acting piston connected to a piston rod 63. Cylinder 62 has an end located between a pair of ears 64 and 66 secured to a middle portion of boom 46. A transverse pivot pin or bolt 67 pivotally connects cylinder 62 to ears 64 and 66. Piston rod 63 has an outer end connected to a transverse head 68 accommodating a pivot pin or bolt 69. Bolt 69 connects a toggle linkage 71 pivotally connected to boom 46 and member 56 to control movement of boom 54 without damage to cylinder 62. Toggle linkage 71 is a control linkage comprising a first toggle links 72 and 73 and second toggle links 74 and 76. Pivot bolt 69 pivotally connects adjacent ends of links 72, 73, and 74, 76. A transverse pivot pin or bolt 77 pivotally connects links 72 and 74 to opposite sides of boom 46 inwardly from bolt 59. Another pivot pin or bolt 78 pivotally connects links 73 and 76 to member 56 and arm 57, as shown in FIG. 4. Bolt 78 is located above pivot bolt 59 so that when cylinder 62 is retracted toggle linkage 71 folds, as shown in FIGS. 1 and 5, and pivots boom 54 about the transverse axis of pivot bolt 59 to swing boom 54 to an extended position. The angular position of boom 54 relative to boom 46 can be changed since cylinder 62 can swing boom 54 about 120 degrees around the axis of pivot bolt 59 without damaging cylinder 62.

Work person carrier 32 is a plastic casing having an open top providing confined support for work person 34. A transverse connector 79 joins carrier 32 to the outer end of boom 54. Carrier 32 is free to pivot on connector 79 to retain the carrier in its upright position regardless of the angular position of boom 54. The control valves and levers 81 for controlling the flow of hydraulic fluid to and from cylinders 48 and 62 are mounted on boom 54 adjacent carrier 32 in a location where they can be used by the work person 34 to change the position of carrier 32 between platform 36 and chamber 33 of railcar 11. Turntable 39 is also controlled with control valves and levers 81 to move carrier 32 in an arcuate path 42 relative to a vertical axis.

A plurality of electric lights 82 mounted on boom 54 provide luminous energy into railcar 11 that enables work person 34 to visually observe the load chamber 33 and particulate materials 83 in the chamber at night or on cloudy days. The area encompassed by the light can be changed by moving either boom 46 or boom 54.

In use to clean the load chamber of a railcar 11 of residual particulate materials, the truck 12 having the vacuum cleaner equipment and lift device 31 is driven to a location adjacent the side of railcar 11, as shown in FIG. 6. The work person 34 climbs onto platform 36 adjacent carrier 32 located on the platform. When booms 46 and 54 are in the folded storage positions, shown in FIG. 3, carrier 32 is on platform 36. The work person 34 manipulates levers 81 to actuate cylinder 48 to selectively pivot boom 46 in upward and downward directions. Cylinder 48 is operable to move boom 46 about pivot bolts 47 about 90 degrees or between a generally horizontal position to a generally vertical position. When boom 46 is moved to a selected position, hydraulic fluid to and from cylinder 48 is blocked whereby cylinder 48 holds boom 46 in the selected position. Turntable 39 is actuated to swing booms 46 and 54 to move basket 32 off of platform 36 and allow carrier 32 to clear engine 29. Hydraulic cylinder 62 is then actuated to fold toggle linkage 71 and pivot boom 54 away from boom 46 in a counterclockwise direction. Toggle linkage 71 and cylinders 48 and 62 allows carrier 32 to be moved below ground level into pit or above ground into chamber 33 of railcar 11. Turntable 39 is operated to swing boom 54 and carrier 32 over the side of railcar 11. Hydraulic cylinder 62 is then expanded to lower carrier 32 and work person 34 into chamber 33 of railcar 11. Work person 34 is in a position to handle hose 22 and locate nozzle 23 adjacent particulate material 83 and at locations containing additional particulate materials. Hose 22 can be attached to boom 54 or carrier 32 with a connector 55, shown in FIG. 6, to allow hydraulic cylinders 48 and 62 to be used to change the location of hose and nozzle 23 in chamber 33. When chamber 33 is clean cylinder 48 is extended to raise boom 54 and carrier 32 and work person out of chamber 33. Turn table 39 is actuated to swing booms 46 and 54 and carrier 32 over truck 12. Boom 54 is returned to the folded position, adjacent boom 46 by extending cylinder 62 to expand toggle linkage 71. Main boom 46 is then returned to a horizontal position by contracting cylinder 48. The lift device 31 is in the transport position as shown in FIG. 3.

The vacuum cleaner vehicle 12 has been described as an apparatus and method for vacuum cleaning an open top railcar. Vehicle 12 can be used to clean tanks, containers, and rooms that have open tops or doors allowing entrance into the interior chambers thereof. The vehicle 12 has a self contained vacuum cleaning system and work person lift device. Changes in the structure and arrangement of structures of the cleaning system and lift device can be made by a person skilled in the art without departing from the method and apparatus of the invention. The invention is defined in the following claims.

What is claimed is:

1. An apparatus for cleaning particulate materials from a chamber of an open top container comprising:

a motor truck, vacuum cleaner means mounted on the truck for collecting and storing particulate materials, said vacuum cleaner means having an enclosed particulate material collection box, an elongated hose connected to the box for carrying particulate materials to the box, said hose having an end with an air inlet opening, a fan for drawing air from the box and moving air through the air inlet opening and hose into the box, said air flowing into the inlet opening picking up particulate materials and said air moving in the hose transporting the particulate materials to the box, power means for driving the fan, a lift device mounted on the truck, a work person carrier connected to the lift device, said lift device having boom means movably mounted on the truck supporting the work person carrier and locating the work person carrier in the chamber of the container, and means connected to the boom means for moving the boom means to locate the work person carrier in the chamber of the container.

2. The apparatus of claim 1 wherein: the container is an open top railcar having a chamber for holding particulate materials.

3. The apparatus of claim 1 wherein: the work person carrier is a basket pivotally mounted on a remote end portion of the boom means.

4. The apparatus of claim 1 wherein: the boom means comprises a first boom and a second boom, pivot means pivotally connecting the first boom to the second boom, a hydraulic cylinder for moving the second boom relative to the first boom, toggle linkage means for controlling the movement of the second boom, and means pivotally connecting the toggle linkage means to the first and second booms and hydraulic cylinder whereby on actuation of the hydraulic cylinder the toggle linkage means selectively folds and expands to move the second boom relative to the first boom.

5. The apparatus of claim 4 wherein: the toggle linkage means comprises a pair of toggle links, each toggle link having a first member pivotally connected to the first boom, a second member pivotally connected to the second boom, and pivot means pivotally connecting the first and second members and the hydraulic cylinder to the first and second members.

6. The apparatus of claim 4 including: means for pivotally connecting the work person carrier to an outer end portion of the second boom, and means for connecting the hose to the work person carrier.

7. The apparatus of claim 4 wherein: the lift device has a support mounted on the truck, means pivotally connecting the support to the first boom, a hydraulic cylinder connected to the support and first boom operable to raise and lower the first boom.

8. The apparatus of claim 7 wherein: the lift device includes means for turning the first and second booms about a vertical axis.

9. The apparatus of claim 1 wherein: the lift device has a support mounted on the truck, means pivotally connecting the boom means to the support, and a first hydraulic cylinder connected to the support and boom means operable to raise and lower the boom means.

10. The apparatus of claim 9 wherein: the boom means comprises a first boom and a second boom, pivot means pivotally connecting the first boom to the second boom, a second hydraulic cylinder for moving the second boom relative to the first boom, toggle linkage means for controlling the movement of the second boom, and means pivotally connecting the toggle linkage means to the first and second booms and second cylinder whereby on actuation of the second cylinder the toggle linkage means selectively folds and expands to move the second boom relative to the first boom.

11. The apparatus of claim 10 wherein: the toggle linkage means comprises a pair of toggle links, each toggle link having a first member pivotally connected to the first boom, a second member pivotally connected to the second boom, and pivot means pivotally connecting the first and second members and the second cylinder to the first and second members.

12. The apparatus of claim 10 including: means for pivotally connecting the work person carrier to an outer end portion of the second boom, and means for connecting the hose to the work person carrier.

13. The apparatus of claim 1 wherein: said boom means comprises a first boom having an inner end and an outer end, a second boom having an inner end and an outer end, a member secured to the inner end of the second boom extended over a portion of the outer end of the first boom, arm means secured to the member extended toward the outer end of the first boom spacing the member from the outer end of the first boom, pivot means connecting the arm means to the outer end of the first boom, toggle linkage means pivotally connected to the member and outer end of the first boom for controlling the movement of the second boom, said means connected to the boom means comprising a first extendable and contractable means connected to the first boom operable to swing the first boom between up and down positions, and a second extendable and contractable means connected to the first boom and toggle linkage means operable to selectively fold and expand the toggle linkage means to pivot the second boom relative to the first boom and locate the outer end of the second boom in the chamber, and means mounting the work person carrier on the outer end of the second boom whereby a work person positioned in the work person carrier can be located in the chamber and move the end of the hose having the air inlet opening in the chamber to pick up particulate materials located in the chamber.

14. An apparatus for cleaning particulate materials from a railcar having side and end walls surrounding a chamber for holding particulate materials and an open top comprising: a vehicle adapted to be moved to a location adjacent the railcar, vacuum cleaner means mounted on the vehicle for collecting and storing particulate materials, said vacuum cleaner means having an enclosed particulate material collection box, an elongated hose connected to the box for carrying particulate materials to the box, said hose having a remote end with an air inlet opening to allow air to move particulate materials into the hose, means for drawing air from the box and moving air through the air inlet opening and hose into the box, said air flowing into the air inlet opening picking up particulate materials from the chamber and the air flowing in the hose transporting the particulate materials to the box, a lift device mounted on the vehicle, a work person carrier, said lift device having a first boom having an inner end and an outer end, a second boom having an inner end and an outer end, a member secured to the inner end of the second boom extended over a portion of the outer end of the first boom, arm means secured to the member extended toward the outer end of the first boom spacing the member from the outer end of the first boom, pivot means connecting the arm means to the outer end of the first boom, toggle linkage means pivotally connected to the member and outer end of the first boom for controlling the movement of the second boom, a first hydraulic cylinder connected to the first boom operable to swing the first boom between up and down positions, a second hydraulic cylinder connected to the first boom and toggle linkage means operable to selectively fold and expand the toggle linkage means to pivot the second boom relative to the first boom and locate the outer end of the second boom in the chamber of the railcar, and means mounting the work person carrier on the outer end of the second boom whereby a work person positioned in the work person carrier can be located in the chamber of the railcar and move the remote end of the hose in the chamber to pick up particulate materials located in the chamber of the railcar.

15. The apparatus of claim 14 wherein: the toggle linkage means comprises a pair of toggle links, each toggle link having a first member pivotally connected to the first boom, a second member pivotally connected to the member secured to the second boom, and pivot means pivotally connecting the first and second members and the hydraulic cylinder to the first and second members.

16. The apparatus of claim 14 including: means for pivotally connecting the work person carrier to an outer end of the second boom and means for connecting the hose to the work person carrier.

17. The apparatus of claim 14 wherein: the lift device has a support mounted on the truck, means pivotally connecting the support to the first boom, and said first hydraulic cylinder being connected to the support and first boom operable to raise and lower the first boom.

18. The apparatus of claim 17 wherein: the lift device includes means for turning the first and second booms about a vertical axis.

19. An apparatus for cleaning particulate materials from a chamber of an open top container comprising: a vehicle adapted to be moved to a location adjacent the container, vacuum cleaner means mounted on the vehicle for collecting and storing particulate materials, said vacuum cleaner means having an enclosed particulate material collection box, an elongated hose connected to the box for carrying particulate materials to the box, said hose having an end with an air inlet opening, means for drawing air from the box and moving air through the air inlet opening and hose into the box, said air moving in the hose transporting the particulate materials to the box, a lift device mounted on the vehicle, a work person carrier connected to the lift device, said lift device having boom means movably mounted on the vehicles means connected to the boom means for moving the boom means to locate the work person carrier in the chamber of the container, said boom means comprises a first boom having an inner end and an outer end, a second boom having an inner end and an outer end, a member secured to the inner end of the second boom extended over a portion of the outer end of the first boom, arm means secured to the member extended toward the outer end of the first boom spacing the member from the outer end of the first boom, pivot means connecting the arm means to the outer end of the first boom, toggle linkage means pivotally connected to the member and outer end of the first boom for controlling the movement of the second boom, said means connected to the boom means comprising a first extendable and contractable means connected to the first boom operable to swing the first boom between up and down positions, and a second extendable and contractable means connected to the first boom and toggle linkage means operable to selectively fold and expand the toggle linkage means to pivot the second boom relative to the first boom and locate the outer end of the second boom in the chamber, and means mounting the work person carrier on the outer end of the second boom whereby a work person positioned in the work person carrier can be located in the chamber and move the end of the hose having the air inlet opening in the chamber to pick up particulate materials located in the chamber.

20. The apparatus of claim 19 wherein: the toggle linkage means comprises a pair of toggle links, each toggle link having a first member pivotally connected to the first boom, a second member pivotally connected to the second boom, and pivot means pivotally connecting the first and second members and the hydraulic cylinder to the first and second members.

21. The apparatus of claim 19 including: means for pivotally connecting the work person carrier to an outer end of the second boom and means for connecting the hose to the work person carrier.

22. The apparatus of claim 19 wherein: the lift device has a support mounted on the vehicle, means pivotally connecting the support to the first boom, and said first hydraulic cylinder being connected to the support and first boom operable to raise and lower the first boom.

23. The apparatus of claim 22 wherein: the lift device includes means for turning the first and second booms about a vertical axis.

* * * * *

UNITED STATES PATENT AND TRADEMARK OFFICE

CERTIFICATE OF CORRECTION

PATENT NO. : 6,317,919 B1
DATED : November 20, 2001
INVENTOR(S) : William G. Dahlin and William S. Pladson It is certified that error appears in the above-identified patent and that said Letters Patent is hereby corrected as shown below:

Title page,
Delete the title page and replace with the title page on the attached page, Drawings,
Please delete the drawings in the patent and replace with the attached drawings.

Signed and Sealed this

Twenty-sixth Day of March, 2002

*Attest:*

*Attesting Officer*

JAMES E. ROGAN
*Director of the United States Patent and Trademark Office*

(12) United States Patent
Dahlin et al.

(10) Patent No.: US 6,317,919 B1
(45) Date of Patent: Nov. 20, 2001

(54) RAILCAR CLEANING APPARATUS

(76) Inventors: William G. Dahlin; William S. Pladson, both of 1712 Main Ave. #202, Fargo, ND (US) 58103

( * ) Notice: Subject to any disclaimer, the term of this patent is extended or adjusted under 35 U.S.C. 154(b) by 0 days.

(21) Appl. No.: 09/617,004

(22) Filed: Jul. 14, 2000

Related U.S. Application Data

(62) Division of application No. 09/188,270, filed on Nov. 9, 1998.

(60) Provisional application No. 60/105,479, filed on Oct. 23, 1998.

(51) Int. Cl.[7] ..... A47L 5/36

(52) U.S. Cl. ..... 15/314; 15/312.1; 15/340.1

(58) Field of Search ..... 15/340.1, 314, 15/312.1

(56) References Cited

U.S. PATENT DOCUMENTS

| | | | | |
|---|---|---|---|---|
| 3,104,720 | | 9/1963 | Sullivan . | |
| 3,150,404 | * | 9/1964 | Johnson | 15/340.1 X |
| 3,348,258 | * | 10/1967 | Daneman | 15/314 |
| 3,541,631 | | 11/1970 | Kluge et al. . | |
| 3,594,848 | * | 7/1971 | Atkinson | 15/314 |
| 3,600,224 | | 8/1971 | Stilwell . | |
| 3,616,940 | | 11/1971 | Milner, Jr. . | |
| 3,665,545 | | 5/1972 | Beckman . | |
| 3,955,236 | | 5/1976 | Mekelburg . | |
| 3,995,754 | * | 12/1976 | DeKoning | 15/340.1 X |
| 4,200,950 | * | 5/1980 | Coverley | 15/314 |
| 4,222,457 | | 9/1980 | Ashworth . | |
| 4,322,868 | | 4/1982 | Wurster . | |
| 4,366,594 | * | 1/1983 | Hyams | 15/314 |
| 4,643,273 | | 2/1987 | Stokoe . | |
| 4,657,109 | | 4/1987 | Sterner . | |
| 4,659,262 | * | 4/1987 | Van Alst | 15/340.1 X |
| 4,679,653 | | 7/1987 | Pasquarette, Jr. et al. . | |
| 4,746,024 | | 5/1988 | Hensler . | |
| 4,775,029 | | 10/1988 | MacDonald et al. . | |
| 5,142,732 | | 9/1992 | Davis . | |
| 5,159,737 | * | 11/1992 | Kimura et al. | 15/312.1 X |
| 5,239,727 | * | 8/1993 | Roestenberg | 15/314 X |
| 5,846,334 | | 12/1998 | Hoce . | |

FOREIGN PATENT DOCUMENTS

| | | |
|---|---|---|
| 2243359 | 3/1974 | (DE) . |
| 141552 | 5/1985 | (EP) . |

* cited by examiner

*Primary Examiner*—Chris K. Moore

(57) ABSTRACT

A mobile vacuum cleaner for removing particulate materials from a chamber of a railcar or container is mounted on a motor truck operable to locate the vacuum cleaner adjacent a railcar. The cleaner has a material pick-up hose connected to a box and a motor driven fan for drawing air through the hose and box to pick up particulate materials from the chamber of the railcar and transport the particulate materials to the box. A lift device mounted on the truck has articulated booms and a work person carrier that can be located in the chamber of the railcar allowing the work person to move the hose adjacent the particulate material in the chamber and visually observe the cleaning operation.

23 Claims, 5 Drawing Sheets

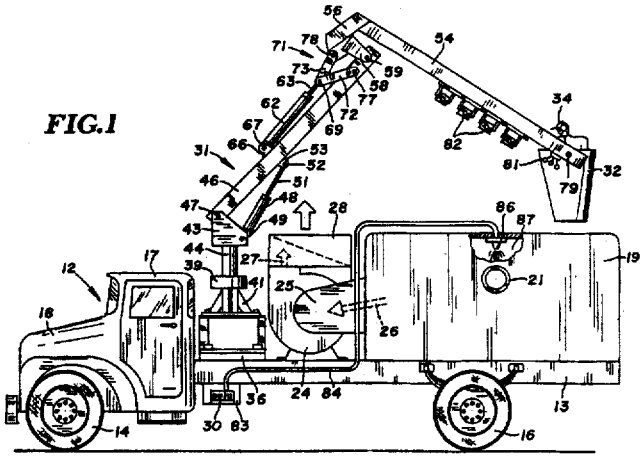

*FIG.1*